US006857797B2

(12) United States Patent
Weast

(10) Patent No.: US 6,857,797 B2
(45) Date of Patent: Feb. 22, 2005

(54) SYSTEM FOR FACILITATING PRINTING ON VARIOUS MEDIA

(75) Inventor: Aaron B. Weast, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 18 days.

(21) Appl. No.: 10/421,579

(22) Filed: Apr. 22, 2003

(65) Prior Publication Data

US 2004/0213611 A1 Oct. 28, 2004

(51) Int. Cl.[7] ..... B41J 5/30
(52) U.S. Cl. ..... 400/61; 400/76; 347/104
(58) Field of Search ..... 400/61–63, 70, 400/76; 347/104, 105

(56) References Cited

U.S. PATENT DOCUMENTS 6,148,722 A * 11/2000 Hagstrom ..... 101/35
6,270,176 B1 * 8/2001 Kahle ..... 347/2
6,360,657 B1 * 3/2002 Tanabe et al. ..... 101/44
6,612,762 B1 * 9/2003 Sakurai et al. ..... 400/542
6,709,175 B1 * 3/2004 Drynkin et al. ..... 400/48
2003/0234852 A1 * 12/2003 Oshima et al. ..... 347/104
2004/0017457 A1 * 1/2004 Anami et al. ..... 347/104

FOREIGN PATENT DOCUMENTS

JP 2002002056 A * 1/2002 ..... B41J/25/308

* cited by examiner

*Primary Examiner*—Minh Chau

(57) ABSTRACT

A system for facilitating printing on certain media. The system includes a first mechanism for printing via a first media path in a first mode of operation and second mechanism for printing via a second media path in a second mode of operation. In a specific embodiment, the first media path is bi-directional and includes input aperture for receiving print media that is also an output aperture for outputting the print media. A controller selectively controls the mode of operation of the system. In the specific embodiment, the first media path is circular, and the first mechanism includes a mechanism for printing on a compact disc via rotational printing.

29 Claims, 4 Drawing Sheets

SYSTEM FOR FACILITATING PRINTING ON VARIOUS MEDIA

BACKGROUND OF THE INVENTION

1. Field of Invention

This invention relates to printers. Specifically, the present invention relates to systems and methods for facilitating printing on various media, such as compact discs and paper.

2. Description of the Related Art

Printers are employed to print on various media types, including compact discs, boxes, signs, and so on. Such applications, however, often require expensive specialized printers designed to print on objects other than paper or transparencies.

Common household printers are typically adapted for printing on flexible media, and often incorporate bent paper paths to meet certain design constraints. For example, full-bleed (zero-margin) printing assemblies often require star wheels to help control the shape of the print media. Star wheel configurations typically require a bent paper path for optimal print quality. Consequently, such printers often cannot print on relatively rigid media, such as compact discs. Additionally, placing a bend in the paper reduces the risk of the print heads contacting the paper during high ink volume printing due to paper swelling (cockle growth).

To print on relatively rigid media, some inkjet printers are designed with a straight-through paper path, and employ a pen-to-paper spacing lever to accommodate thicker print media. Unfortunately, print quality is greatly reduced if a user forgets to re-adjust the lever to print on thin media, such as paper. Consequently, incorporation of manually controlled pen-to-paper spacing levers to facilitate printing on relatively thick and/or rigid media may result in increased calls to technical support and reduced overall user-satisfaction. Furthermore, compact discs pass through such printers via the paper path. Consequently, various guide rollers may sometimes unevenly translate the compact disc through the paper path, resulting in printing errors. In addition, star wheels may mark or smear printed surfaces of the compact disc, since compact disc surfaces are thicker and more susceptible to smearing and marking by star wheels than conventional paper.

Hence, a need exists in the art for an efficient system and method for facilitating printing on various media, such as compact discs, without requiring significant modification of conventional bent paper paths.

SUMMARY OF THE INVENTION

The need in the art is addressed by the system for facilitating printing on certain media of the present invention. In the illustrative embodiment, the inventive system is adapted for use with printing on compact discs. The system includes a first mechanism for printing via a first circular media path in a first mode of operation and second mechanism for printing via a second media path in a second mode of operation.

In a specific embodiment, the first circular media path is bi-directional and includes an input aperture for receiving certain print media that is also an output aperture for outputting the certain print media. A controller selectively controls the mode of operation of the system.

In the specific embodiment, the first mechanism includes a mechanism for printing on a compact disc via rotational printing. The mechanism for printing on a compact disc includes a cartridge that accommodates the compact disc, allowing the compact disc to rotate about a predetermined axis. The first and second mechanisms include a feed roller and a printer pen. The feed roller and the printer pen are controlled via the controller, in accordance with the mode of operation. The cartridge is positioned relative to the feed roller to enable rotation of the compact disc via the feed roller. An additional mechanism automatically adjusts the spacing between the firs paper path and a print mechanism upon insertion and/or removal of the removable accessory to and/or from the printer.

The novel design of printing systems, constructed in accordance with the teachings of the present invention, is facilitated by the first and second mechanisms, which facilitate printing on various media, such as compact discs and paper without requiring significant modification of conventional bent paper paths. Furthermore, in some embodiments of the present invention, by rotating certain print media, such as a compact disc, rather than translating the compact disc through a printer path, more accurate printing is obtained, and complex modifications to paper drive systems are not required to accommodate printing on compact discs. In addition, by accommodating the compact disc in a removable accessory, such as a cleanout accessory, requisite design modifications to existing printers that employ cleanout accessories is minimal. Furthermore, since the compact disc never passes completely along the paper path, pre-existing star wheel assemblies and other printing features may coexist with the printing systems, constructed in accordance with the teachings of the present invention. In addition, by rotating the compact disc, such as via a pre-existing feed roller, implementation costs, and the need to alter electronics, drive gears, belts, and so on, are minimized.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
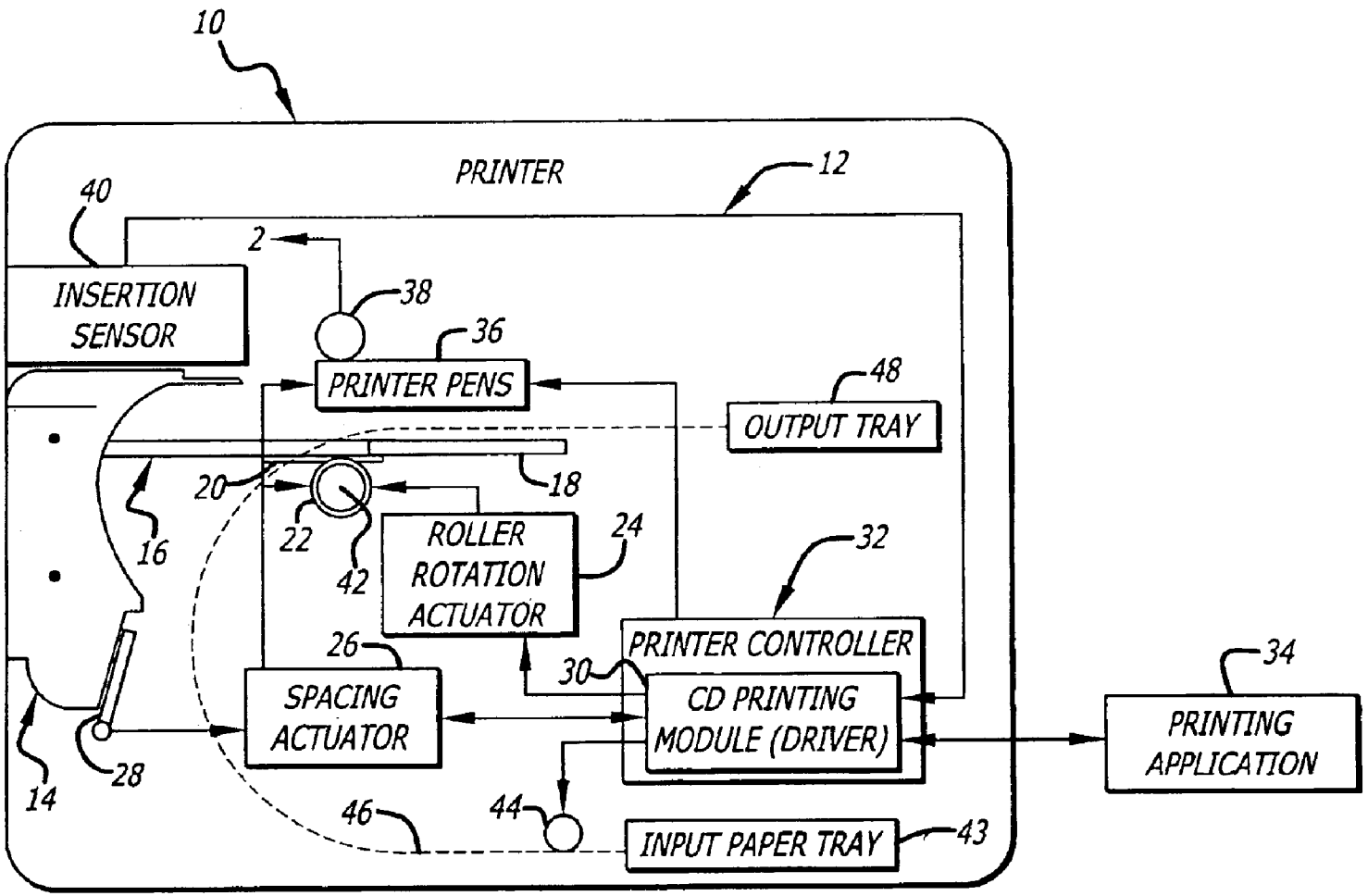
FIG. 1 is a diagram of a printer employing a Compact Disc (CD) printing accessory constructed in accordance with the teachings of the present invention and adapted to print on a compact disc.

FIG. 1 is a diagram of a printer 10 employing a CD printing accessory 14 constructed in accordance with the teachings of the present invention and adapted to print on a Compact Disc (CD) 18. Those skilled in the art will appreciate that the teachings disclosed herein may be adapted to print on certain print media other than CD's, without departing from the scope of the present invention. For clarity, various components, such as power supplies, operating systems, star wheels, paper paths, and so on, have been omitted from the figures. However, those skilled in the art with access to the present teachings will-know which components to implement and how to implement them to meet the needs of a given application.

The printer 10 includes a novel printing system 12 adapted to print on the compact disc 18. The printing system 12 includes the CD accessory 14, which includes a CD holder 16 that protrudes from the accessory 14 into the body of the printer 10 and holds the CD 18. The accessory 14 may occupy a cleanout accessory slot (not shown) that exists on many currently available printers. The accessory may implemented as cartridge or related accessory.

A protrusion 20 is rotatably mounted to the CD holder 16 and protrudes from the bottom of the holder 16. The protrusion 20 is mechanically linked to the compact disc 18 so that rotation of the protrusion 20 rotates the compact disc 18. The protrusion 20 extends sufficiently from the CD holder 16 to enable gripping of the protrusion 20 by a roller 22 mounted on a roller drive shaft 42. The roller 22 may be a feed roller, such as the pre-existing feed roller used in many existing printers.

A roller rotation actuator 24 is connected to the roller 22 and is responsive to control signals from a CD printing module and driver 30 running on a printer controller 32. The CD printing module 30 also communicates with a roller spacing actuator 26, which is capable of controlling the distance, called pen spacing, between printer pens 36, which ride on a pen shaft 38, and the surface of the CD 18 by selectively moving the roller 22 and/or the printer pens 36. In some implementations, translation of the roller 22 may translate the CD holder 16 and accompanying CD 18, accordingly. In these implementations, the CD holder 16 may slide vertically in the cleanout accessory 14. Additional mechanisms (not shown) or positioning the CD holder 16 along the accessory may be employed.

For the purposes of the present discussion, the printing surface of the printer pens 36 is called a print zone. The printer pens 36 are called a print mechanism. The roller spacing actuator 26 may control the distance between the print zone of the printer pens 36 and the surface of the CD 18 via other mechanisms without departing from the scope of the present invention. For example, the roller spacing actuator 26 may act as a printer pen actuator to selectively translate the printer pens 36 to move the printer pens 36 closer or farther from the CD 18.

A spacing lever 28 is connected, either mechanically or electrically, to the roller spacing actuator 26. In the present embodiment, the roller spacing actuator 26 receives control signals from the spacing lever 28 and/or the CD printing module 30.

The CD printing module 30 receives input from a printing application 34. In addition, the CD printing module 30 receives input from an insertion sensor 40 positioned to sense when the CD printing accessory 14 is inserted in the printer 10. The insertion sensor 40 (which may be an optical sensor) or the lever 28 may be removed without departing from the scope of the present invention.

In operation, a user wishing to print on the CD 18 inserts the CD into the CD holder 16 and closes its cover. The accessory is then inserted into the printer 10. Insertion of the accessory triggers the lever 28, which causes the roller spacing actuator 26 to adjust the spacing between the printer pens 36 and the surface of the CD 18, accordingly. Alternatively, the insertion sensor 40 detects insertion of the accessory and forwards a signal in response thereto to the CD printing module 30. The CD printing module 30 may also issue control signals to command the roller spacing actuator 26 to adjust the position of the roller 22 or pen spacing, as needed. The roller spacing actuator 26 may also forward a signal to the CD printing module 30 indicating that the accessory has been inserted in the printer 10.

The CD printing module 30 then receives data corresponding to an image to be printed from the printing application 34. The CD printing module 30 and printer controller 32 then generate roller actuator controls signals to the rotation actuator 24, and pen firing and position control signals to the printer pens 36. The printer pens 36 include an actuator (not shown) that is responsive to pen position control signals from the printer controller 32 and selectively translates the printer pens 36 along the pen shaft 38 in response thereto.

The printer pens 36 fire at predetermined times when the printer pens 36 are at predetermined positions, as determined via control signals from the printer controller 32. Simultaneously, the roller actuation signals fed to the roller rotation actuator 24 from the CD printing module 30 cause the roller 22 to rotate by predetermined desired amounts. Rotation of the roller 22 about the roller shaft 42 causes rotation of the CD 18. As the CD 18 rotates, different areas of the CD 18 are exposed to the print zone under the printer pens 36. By controlling the position of the surface of the CD 18 and the firing and position of the pens 36, the desired image provided by the printing application 34 may be printed on the CD 18. Those skilled in the art with access to the present teachings may readily design and program requisite software to implement the CD printing module 30.

In the present specific embodiment, the lever 28 is spring loaded or otherwise configured so that removal of the CD printing accessory 14 causes the lever 28 to return to its original position, which returns the roller 22 and printer pens 36 to their original positions. Consequently, the user no longer must remember to readjust pen-to-paper, i.e., pen-to-media spacing.

The spacing lever 28 is positioned to flip upon insertion of the CD printing accessory 14 and return upon removal of the accessory from the printer. The spacing lever 28 may be configured so that flipping of the spacing lever 28 may generate a signal to the roller spacing actuator. 26, which then adjusts the pen spacing in response thereto. Alternatively, the spacing lever 28 is mechanically linked to the printer pens 36 and accompanying pen drive shaft 38.

The accessory may be readily adapted to printer designs, especially those already accommodating different printer cleanout accessories. Printer designers may maintain existing star wheel configurations, which may yield the best paper shape and print quality in some applications. Star wheel configurations typically require a bent paper path for optimal print quality. Bent paper paths may help improve print quality by adding stress to the paper so the paper shape is better controlled during printing.

Since, the CD 18 never passes completely though the paper path, star wheel assemblies and similar features are easily accommodated into printer designs without having to design mechanisms to enable a CD to pass through the main paper path. Use of cleanout accessories, such as the accessory prevents accompanying star wheels from marking the printed surface of the CD 18.

Furthermore, use of the accessory, in accordance with the teachings of the present invention, facilitates automatic adjustment of the pen spacing, i.e., the distance between the print zone of the printer pens 36 and the surface of the CD 18. Consequently, quality problems resulting from users forgetting to re-adjust pen-to-paper spacing are avoided.

The printer 10 also accommodates printing on media such as paper or transparencies. The printer 10 includes an input paper tray 43 and an accompanying media pick mechanism 44, which is controllable via the CD printing module 30 running on the printer controller 32. The pick mechanism 44 picks print media, such as paper from the input paper tray 43, and delivers it along a paper path 46, which includes various guide rollers and the feed roller 22. The feed roller 22 feeds paper travelling along the paper path 46 under the printer pens 36 and to the output tray 48.

Print media, such as paper is inserted in the paper tray 43. The CD printing module 30 or other software running on the printer controller 32 may determine whether an existing print job from the printing application 34 should be printed via the CD accessory or via the paper path 46. Control signals issued by the CD printing module 30 to the pick mechanism 44 and the printer pens 36 may then be adjusted accordingly.

Hence, use of the accessory, accompanying CD printing module 30, and the actuators 24 and 26 enable the printer 10 to efficiently print on various media, such as the CD 18 and paper, without requiring significant modification of bent paper paths, such as the bent paper path 46. The printer 10 acts as an efficient dual-use printer capable of printing on various media types. One skilled in the art with access to the present teachings could modify an existing printer having a bent paper path to accommodate the CD accessory without undue experimentation. Using a pre-existing feed roller to implement the feed roller 22 to rotate the CD 18 via the unique protrusion 20 in the. CD holder 16 reduces costs of implementing CD printing solutions in accordance with the teachings of the present invention.

Points on the surface of the CD 18 travel a circular path, which passes under the printer pens 36 via rotation of the feed roller 22. Insertion of the accessory into the printer 10 may be thought of as selective adaptation of the paper path 46 and accompanying feed roller 22 to accommodate rotational printing.

The circular path is employed during a first mode of operation, wherein the printer 10 prints on the CD 18. The media path 46 is employed during a second mode of operation, wherein the printer 10 prints on print media, such as paper from the input paper tray 43. The printing mode is controlled via the printer controller 32 and accompanying CD printing module 30 in response to signaling from the printing application. Alternatively, the mode of the printer 10 may be changed via other signaling, such as via signaling from the spacing actuator 26 to the controller 32 indicating that the accessory has been inserted.

In the specific embodiment of FIG. 1, the accessory fits in a slot or aperture designed to accommodate accessories, such as cleanout accessories, and may be inserted and/or removed therefrom. The accessory enables insertion of print media into the printer 10 via the same path that it is removed. This bi-directional media feed capability reduces the need for an additional output aperture.

Alternatively, the accessory may be permanently integrated with the printer 10 so that it is non-removable. In this alternative application, another built-in mechanism would be provided to enable removal and insertion of the CD 18 and rotation of the CD 18 under the printer pens 36.

The teachings of the present disclosure may be adapted to print on objects other than CD's. In these applications, the accessory is adapted to selectively change the orientation of the object to be printed on relative to the surface of the printer pens 36. This change of orientation may include rotation about a predetermined axis or other orientation change to expose different areas of the object to be printed to the printer pens 36. The object may not require translation through the entire paper path 46 as in certain existing printer designs.

Figure 2:
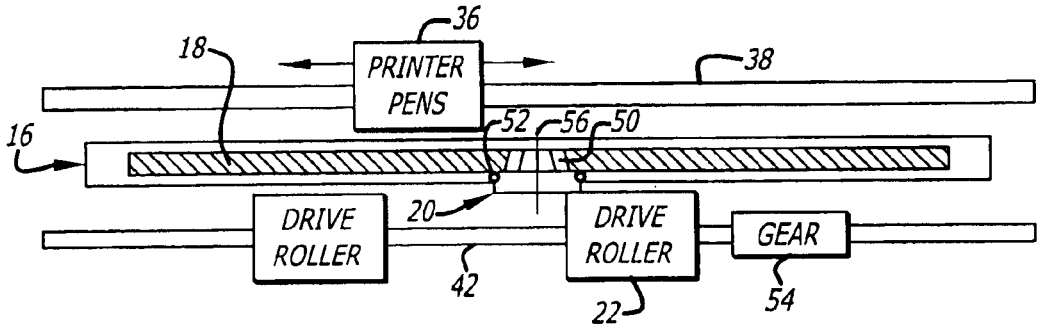
FIG. 2 is a cross-sectional view of the CD printing accessory of FIG. 1 accommodating a compact disc.

FIG. 2 is a cross-sectional view of the CD printing accessory 14 of FIG. 1 accommodating a compact disc 18. In the present specific embodiment, the protrusion 20 extends from the CD holder 16 and includes a CD gripper 50 that extends through to the inside of the CD holder 16 and grips the center portion of the CD 18. The protrusion 20 is rotatably connected to the base of the CD holder 16 via a bearing 52. The protrusion 20 may rotate about a longitudinal axis 56 of the CD 18 and protrusion 20.

The drive roller 22 contacts the disc-shaped protrusion 20 near the edge of the protrusion 20. Rotation of the drive roller 22 causes rotation of the CD 18 via rotation of the protrusion 20, which is rigidly connected to the CD gripper 50. The CD gripper 50 grips the CD 18 so that rotation of the drive roller 22 results in rotation of the CD 18 within the CD holder 16. The CD holder 16 may fold open from the top to facilitate inserting the CD 18 so that the center portion of the CD 18 fits on the CD gripper 50.

A gear 54 positioned in the roller drive shaft 42 facilitates controlling rotation rate of the drive roller 22. In certain implementations, the gear 54 may be employed to rotate the CD 18, such as via an extension that contacts the edge of the CD 18 that protrudes forward from the CD holder 16. Alternatively, the protrusion 20 is omitted, and the CD 18 is rotated by sufficiently angling the CD 18 so that one of the drive rollers 22 contacts the underside of the CD 18. Such an implementation may require appropriate adjustments to printer pen firing control signals from the CD printing module 30 to appropriately compensate for the slope in pen spacing between the print zone and the surface of the CD 18.

Those skilled in the art with access to the present teachings may readily implement various components, such as the protrusion 20, bearing 52, gripper 50, and holder 16 without undue experimentation. In addition, those skilled in the art will appreciate that the printer pens 36 may be replaced by a printing mechanism other than inkjet pens, without departing from the scope of the present invention.

The CD gripper 50 and holder 16 secure the CD throughout the printing process. Little or no changes are required to many existing printer drive systems to accommodate printing on the CD 18 via a printing system constructed, in accordance with the teachings of the present invention. Many existing printer drive systems already have a drive roller and printer pens, which may be readily adapted to accommodate a CD printing system constructed in accordance with the teachings of the present invention.

Figure 3:
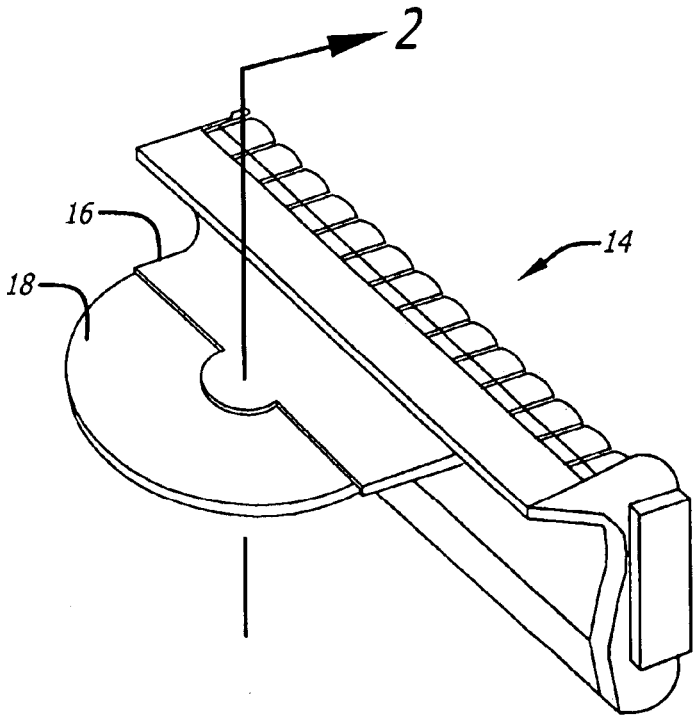
FIG. 3 is a perspective view of the CD printing accessory of FIG. 1.

FIG. 3 is a perspective view of the CD printing accessory 14 of FIG. 1. In the present specific embodiment, the CD printing accessory 14 is shaped to readily fit in cleanout accessory slots of some existing printer designs. The CD cover 16 is designed to fit the CD 18 so that the CD 16 may freely rotate, yet is protected from internal printer parts.

Figure 4:
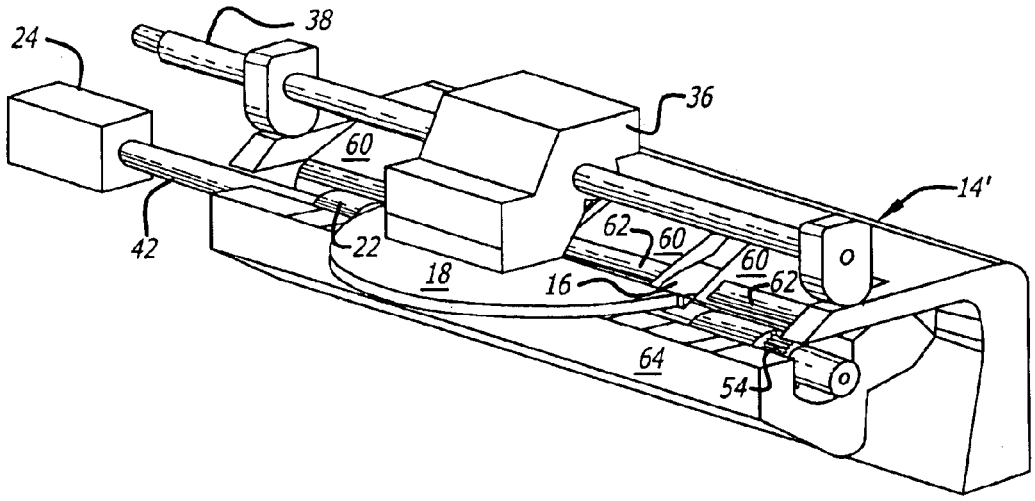
FIG. 4 is a perspective view of an alternative embodiment of the printer CD printing accessory of FIG. 1 and showing exemplary positioning of a printer pen, feed roller, and roller support structure.

FIG. 4 is a perspective view of an alternative embodiment 14' of the printer CD printing accessory 14 of FIG. 1 and showing exemplary positioning of the printer pens 36, feed roller 22, and roller support structure 64. Various structures, such as the feed roller 22, feed roller shaft 42, feed roller actuator 24, feed roller support structure 64, printer pens 36, and pen shaft 38 may be adapted from readily available printer components without undue experimentation.

The alternative CD printing accessory 14' includes additional rollers 62 and roller support structures 60 that extend from the top of the CD printing accessory 14'. Centrally positioned additional rollers 62, also called pinch rollers, rest on the CD cover 16. The top surface of the CD cover 16 protects and supports the CD 18. The far right roller 62 rests on a drive roller 22. Use of the additional rollers 62 may help stabilize the accessory' in some applications.

In the present embodiment, the roller support structures 60, also called upper paper guides, and the pinch rollers 62 do not rest on or clamp the CD 18. The CD cover 16 protrudes just beyond these components 60 and 62 to allow free motion of the CD 18.

Figure 5:
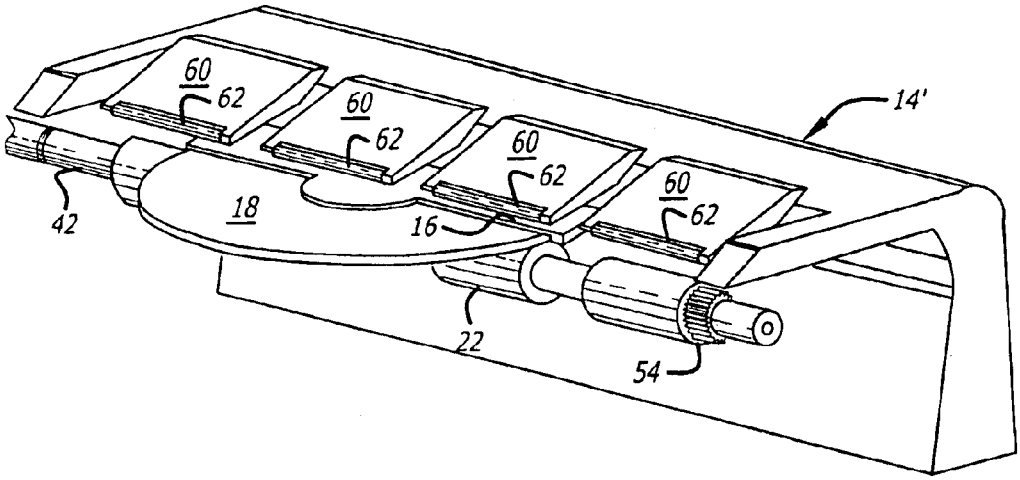
FIG. 5 is a perspective view of the CD printing accessory of FIG. 4 without the accompanying printer pen and roller support structure.

FIG. 5 is a perspective view of the CD printing accessory 14' of FIG. 4 without the accompanying printer pens 36 and roller support structure 64 shown. The gear 54 and feed rollers 22 are more clearly shown.

Figure 6:
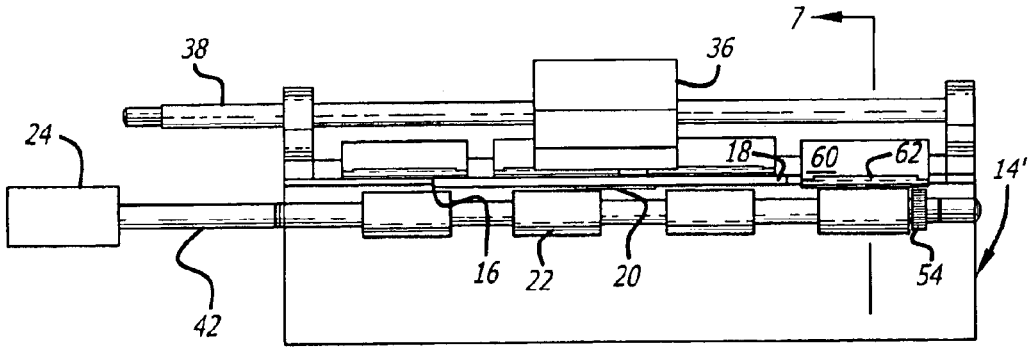
FIG. 6 is a front view of the CD printing accessory of FIG. 4 without the roller support structure.

FIG. 6 is a front view of the CD printing accessory 14' of FIG. 4 without the roller support structure 64. Contact between the feed roller 22 and the protrusion 20 of the CD cover 16 and contact between the far right additional roller 62 and one of the feed rollers 22 are clearly shown.

Figure 7:
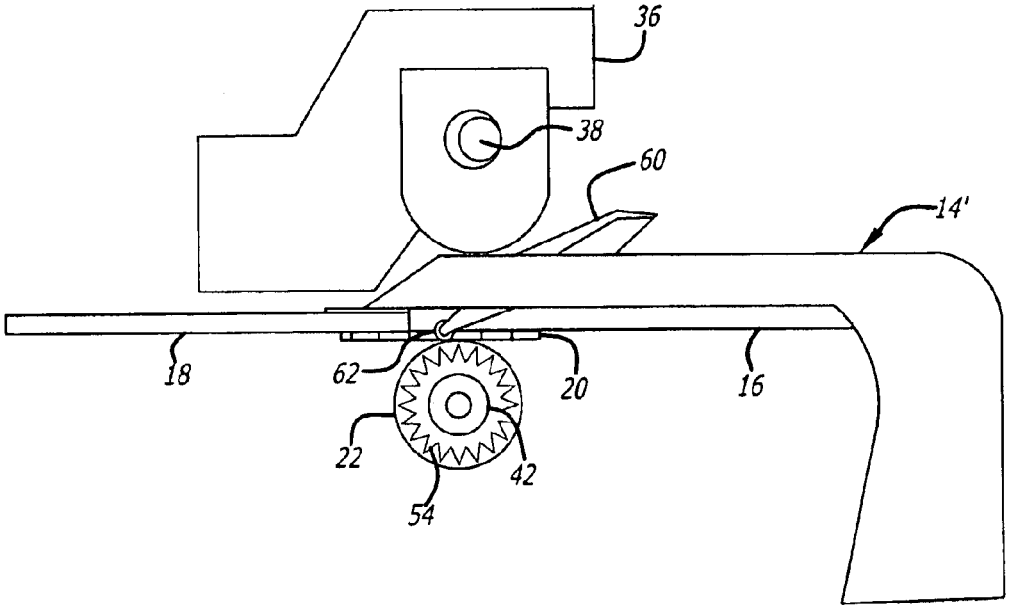
FIG. 7 is a cross-sectional view of the CD printing accessory of FIG. 6.

FIG. 7 is a cross-sectional view of the CD printing accessory 14' of FIG. 6. In the present alternative embodiment, the CD holder 16 is positioned flush against the top support surface of the CD accessory' to help stabilize the holder 16. The CD 18 may be installed in the holder 16 in preparation for printing by snapping open the bottom of CD holder 16 and inserting the CD accordingly so that the CD gripper 50 as shown in FIG. 2 can grip the central portion of the CD 18.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A printer comprising:

first means for printing via a first media path along which media travels in a first mode of operation, said first media path being a circular media path during printing upon the media and second means for printing via a second media path in a second mode of operation.

2. The printer of claim 1 wherein said first and second media paths are controlled by similar drive systems or share one or more drive system components.

3. The printer of claim 2 wherein said similar drive systems include a feed roller that selectively rotates first print media under a print mechanism along said first media path, and wherein said feed roller selectively translates second print media under said print mechanism along a second media path.

4. The printer of claim 3 wherein said first means is adapted to receive first media in a first direction for printing and release said first media in a second direction thereafter, said second direction being opposite said first direction.

5. The printer of claim 3 further including a controller for selectively controlling said mode of operation.

6. The printer of claim 5 wherein said first means includes means for printing on a compact disc via rotational printing.

7. The printer of claim 6 wherein said means for printing on a compact disc includes a cartridge that accommodates said compact disc, said cartridge allowing said compact disc to rotate about a predetermined axis.

8. The printer of claim 7 further including a printer pen, said printer pen and feed roller controlled via said controller in accordance with said mode of operation.

9. The printer of claim 8 wherein said cartridge is positioned relative to said feed roller to enable rotation of said compact disc via said feed roller.

10. The printer of claim 9 further including means for automatically adjusting spacing between said first paper path and a print mechanism upon insertion and/or removal of said cartridge from said printer.

11. A printer capable of printing on various media types comprising:

a first print media path extending between an input of said printer and an output of said printer to accommodate translational printing; and first means for selectively adapting a portion of said print media path to accommodate rotational printing.

12. The printer of claim 11 wherein said first means includes a feed roller and a controller, said feed roller responsive to control signals from said controller, said control signals resulting in selective rotation of certain print media via said feed roller.

13. The printer of claim 12 wherein said first means includes an accessory that accommodates said certain print media.

14. The printer of claim 13 wherein said certain print media includes a compact disc.

15. The printer of claim 14 wherein said first means includes an input aperture to accommodate said accessory and said compact disc and includes an output aperture, which is the same as said input aperture.

16. A printer comprising:

a controller for establishing a mode of operation of said printer and providing a signal in response thereto;

first means for printing on a first type of print media in response to said signal, said first type of print media traveling along a first paper path through said printer; and second means for selectively changing the orientation of a second type of print media relative to said first paper path adjacent the first means for printing to accommodate printing on said second type of print media in response to said signal.

17. The printer of claim 16 wherein said second means includes means for enabling bi-directional feed of said second type of print media.

18. A method for facilitating printing on various print media comprising:

printing on a first media while the first media travels along a first circular media path in a first mode of operation and printing on a second media while the media travels along a second media path in a second mode of operation.

19. A apparatus comprising:

at least one image forming device; and at least one first actuator configured to translate a first medium during image formation on the first medium and to rotate a second medium during image formation on the second medium.

20. The apparatus of claim 19 wherein the at least one actuator includes a roller configured to translate the first medium during the image formation on the first medium and to rotate the second medium during image formation on the second medium.

21. The apparatus of claim 19 wherein the at least one image forming device is configured to deposit material upon the first medium.

22. The apparatus of claim 21 wherein the at least one image forming device is configured to deposit material on the second medium.

23. The apparatus of claim 22 wherein the material comprises an ink.

24. The apparatus of claim 19 wherein the at least one image forming device includes an image forming device that is configured to form an image on both the first medium and the second medium.

25. The apparatus of claim 19 wherein the at least one actuator is configured to rotate the second medium by at least 360 degrees.

26. The apparatus of claim 19 including a cartridge removable from a reminder of the apparatus and configured to hold the second medium and to permit rotation of the second medium.

27. The apparatus of claim 26 including at least one second actuator configured to adjust spacing between the at least one image forming device and the second medium in response to insertion of the cartridge.

28. The apparatus of claim 19 including at least one second actuator configured to adjust spacing between the at least one image forming device and the second medium.

29. The apparatus of claim 28 wherein the at least one second actuator is configured to automatically adjust the spacing when and image is being formed upon the second medium.

* * * * *